US005261144A

United States Patent [19]

Mitchell et al.

[11] Patent Number: 5,261,144

[45] Date of Patent: Nov. 16, 1993

[54] TROWEL BLIND

[76] Inventors: Larry A. Mitchell; Diana L. Mitchell, both of 1914 Cherry St., Amarillo, Tex. 79106

[21] Appl. No.: 967,866

[22] Filed: Oct. 28, 1992

[51] Int. Cl.[5] ..... B05C 17/10

[52] U.S. Cl. ..... 15/235.4; 15/144.4; 15/236.01; 15/245.1

[58] Field of Search ..... 15/235.3, 235.4, 236.01, 15/236.07, 245, 245.1, 144.4, 235.8

[56] References Cited

U.S. PATENT DOCUMENTS

| | | | |
|---|---|---|---|
| 1,306,135 | 6/1919 | Bricker | 15/235.4 |
| 3,090,984 | 5/1963 | Dunnigan | 15/235.4 |
| 3,213,476 | 10/1965 | Lasker | 15/235.4 |
| 3,407,424 | 10/1968 | Lanzarone et al. | 15/144.4 |
| 4,207,674 | 6/1980 | Heronema | 15/236.01 |

FOREIGN PATENT DOCUMENTS

| | | | |
|---|---|---|---|
| 554421 | 3/1958 | Canada | 15/236.07 |
| 2512095 | 3/1982 | France | 15/235.8 |
| 513875 | 9/1956 | Italy | 15/236.01 |
| 258485 | 9/1926 | United Kingdom | 15/245 |
| 450830 | 7/1936 | United Kingdom | 15/245 |
| 919745 | 2/1963 | United Kingdom | 15/245 |
| 1577936 | 10/1980 | United Kingdom | 15/235.4 |

*Primary Examiner*—Harvey C. Hornsby
*Assistant Examiner*—Mark Spisich
*Attorney, Agent, or Firm*—Leon Gilden

[57] ABSTRACT

A trowel tool is arranged to include a U-shaped blade holder receiving an elongate blade having a concave top face and a convex bottom face. The trowel tool includes a telescoping handle arrangement mounted medially and orthogonally relative to the blade holder structure.

2 Claims, 4 Drawing Sheets

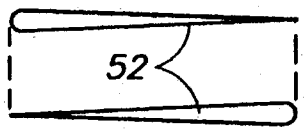
FIG. 9
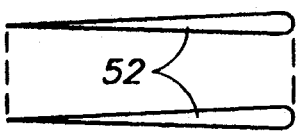
FIG. 8
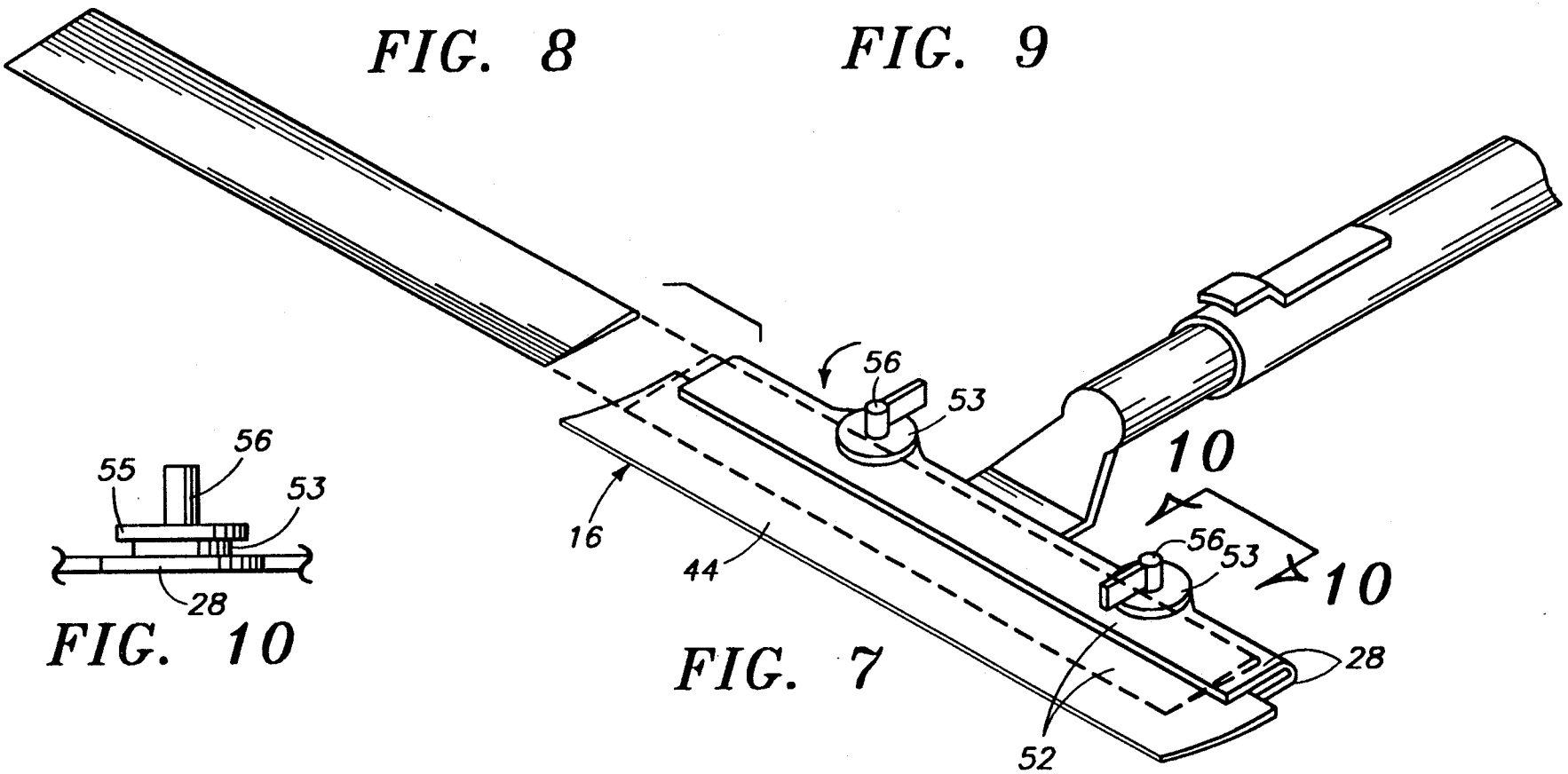
FIG. 7
FIG. 10

TROWEL BLIND

BACKGROUND OF THE INVENTION

1. Field of the Invention

The field of invention relates to trowel tool structure, and more particularly pertains to a new and improved trowel tool arranged to direct finishing of gypsum-joint compound substances.

2. Description of the Prior Art

Gypsum compound is typically sprayed, rolled, or floated onto a sheet rock substrate, wherein the instant invention attempts to overcome deficiencies of the prior art by providing for a blade structure arranged to provide for effecting texturing of gypsum-joint compound substances relative to a work surface not available by the typical rigidity of prior art structure.

BACKGROUND AND SUMMARY OF THE INVENTION

The trowel preferably includes an elongated handle that can be grasped and manipulated by a workman standing within a room, whereby the trowel surface is engageable against ceiling surfaces or elevated wall surfaces near the ceiling. The trowel surface is preferably formed by an elongated transversely curved blade having a convexly curved surface movable along the wet gypsum joint compound surface to perform a smoothing function.

Due to the transverse curvature of the blade, the workman can hold the handle at a range of different angles (relative to the wall or ceiling), while still achieving a satisfactorily smooth wall surface. The blade has substantial surface area contact with the gypsum-joint compound surface, such that relatively low unit area forces are exerted on gypsum joint compound particles. Small particles can be sprayed on gypsum joint compound can be flattened slightly by this tool without bodily shifting gypsum joint compound to form hills and valleys along sheetrock surface for decorative appearance to fill void spots without bodily shifting of the plaster as would form hills and valleys along the plaster surface.

SUMMARY OF THE INVENTION

In view of the foregoing disadvantages inherent in the known types of trowel tool structure now present in the prior art, the present invention provides a trowel tool wherein the same is arranged to effectively spread gypsum-joint compound substance onto an associated substrate. As such, the general purpose of the present invention, which will be described subsequently in greater detail, is to provide a new and improved trowel tool which has all the advantages of the prior art trowel tool apparatus and none of the disadvantages.

To attain this, the present invention provides a trowel tool arranged to include a U-shaped blade holder receiving an elongate blade having a concave top face and a convex bottom face. The trowel tool includes a telescoping handle arrangement mounted medially and orthogonally relative to the blade holder structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trowel tool which has all the advantages of the prior art trowel tool apparatus and none of the disadvantages.

It is another object of the present invention to provide a new and improved trowel tool which may be easily and efficiently manufactured and marketed.

It is a further object of the present invention to provide a new and improved trowel tool which is of a durable and reliable construction.

An even further object of the present invention is to provide a new and improved trowel tool which is susceptible of a low cost of manufacture with regard to both materials and labor, and which accordingly is then susceptible of low prices of sale to the consuming public, thereby making such trowel tools economically available to the buying public.

Still yet another object of the present invention is to provide a new and improved trowel tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of a modified aspect of the invention utilizing stiffening ribs.

FIG. 8 and FIG. 9 are orthographic end views of stiffening blades employed by the invention to effect selective stiffening of the tool structure of the invention.

FIG. 10 is an orthographic view, taken along the lines 10—10 of FIG. 7 in the direction indicated by the arrows.

DESCRIPTION OF THE PREFERRED EMBODIMENT

Figure 1:
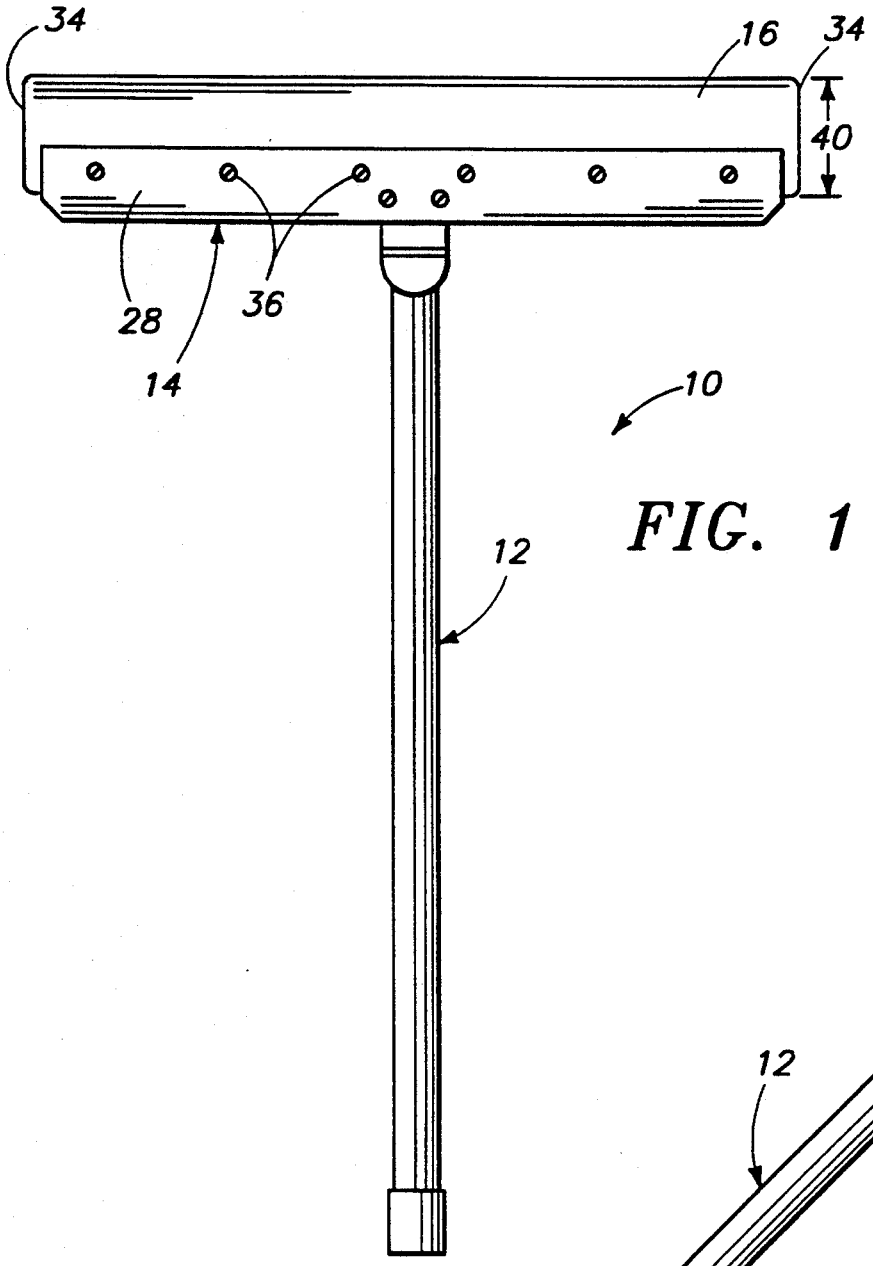
FIG. 1 is an orthographic view of the instant invention.

With reference now to the drawings, and in particular to FIGS. 1 to 10 thereof, a new and improved trowel tool embodying the principles and concepts of the present invention and generally designated by the reference numeral 10 will be described.

The drawings show a drywall perfatapers 10 that comprises an elongated handle 12, blade holder 14, and trowel blade 16. Holder 14 is permanently attached to handle 12. Blade 16 is removably mounted in the blade holder by screws, such that when the blade is worn it can be removed from the holder and replaced with a new blade.

The illustrated elongated handle 12 comprises two tubular handle components 18 and 20 telescopically connected, one within the other, so that the two components can be adjusted longitudinally to change the effective length of the handle. In its contracted condition the handle is preferably about two and one half feet long. In its extended condition of adjustment, the handle may be about four feet long.

Tubular component 18 has a series of small holes 22 spaced therealong. A detent button 24 is carried on a leaf spring 26 that has one end thereof attached to the outer face of tubular component 20. By raising the leaf spring and sliding tube 18 longitudinally, detent button 24 can be made to selectively enter into any one of holes 22, for thereby holding the tubular components in selected positions of adjustment.

Blade holder 14 is shown as a U-shaped channel member that defines two spaced-apart parallel plates 28. If desired, the holder could be formed as a single plate 28. The illustrated channel member is connected to handle 12 at the channel member midpoint so that the holder projects laterally from handle axis 30 the same distance in both directions (to the right and to the left in FIG. 2); the longitudinal axis of the holder is normal to handle axis 30. Typically, holder 14 will have a total length of about sixteen inches. The associated blade 16 will have a length of about eighteen inches, such that each end 34 of the blade will project beyond an end edge of the holder by a distance of about one inch. Diagonal braces (rods) can be connected between handle component 18 and the outboard ends of holder 14 to rigidify the handle-holder assembly.

Blade 16 is an elongated element adapted to fit into the insertion slot formed by plates 28. A number of small holes are formed in plates 28 and blade 16 to receive attachment fasteners 36; nuts 38 retain the screws in plate. However, the screws can be removed should it be desired to replace a worn blade 16 with a new unworn blade.

Blade 16 has a transverse width dimension 40 that is substantially greater than the width dimension of plates 28. Accordingly, the blade projects some distance beyond the plate longitudinal edge. Typically, blade width dimension 40 will be approximately one inch; the blade will project beyond the longitudinal edges of plates 28 at least about one half inch.

As shown in FIG. 1, the blade has a transverse curvature such that face 44 of the blade is concave and face 46 of the blade is convex. The trowel is used with the convex face 46 of the blade presented to a moist gypsum-joint compound. The preferred radius of curvature of convex face 46 is approximately two inches. With such a radius the trowel surface at the extreme longitudinal edge of the blade will extend at an angle of approximately thirty degrees to handle axis 30.

In use of the trowel, the workman grasps handle 12 to draw the trowel blade 16 along the plaster surface 47. The convex curved surface 46 has an extensive surface area in contact with the plaster surface, such that the trowel surface exerts only a moderate unit area force on the plaster particles.

Figure 2:
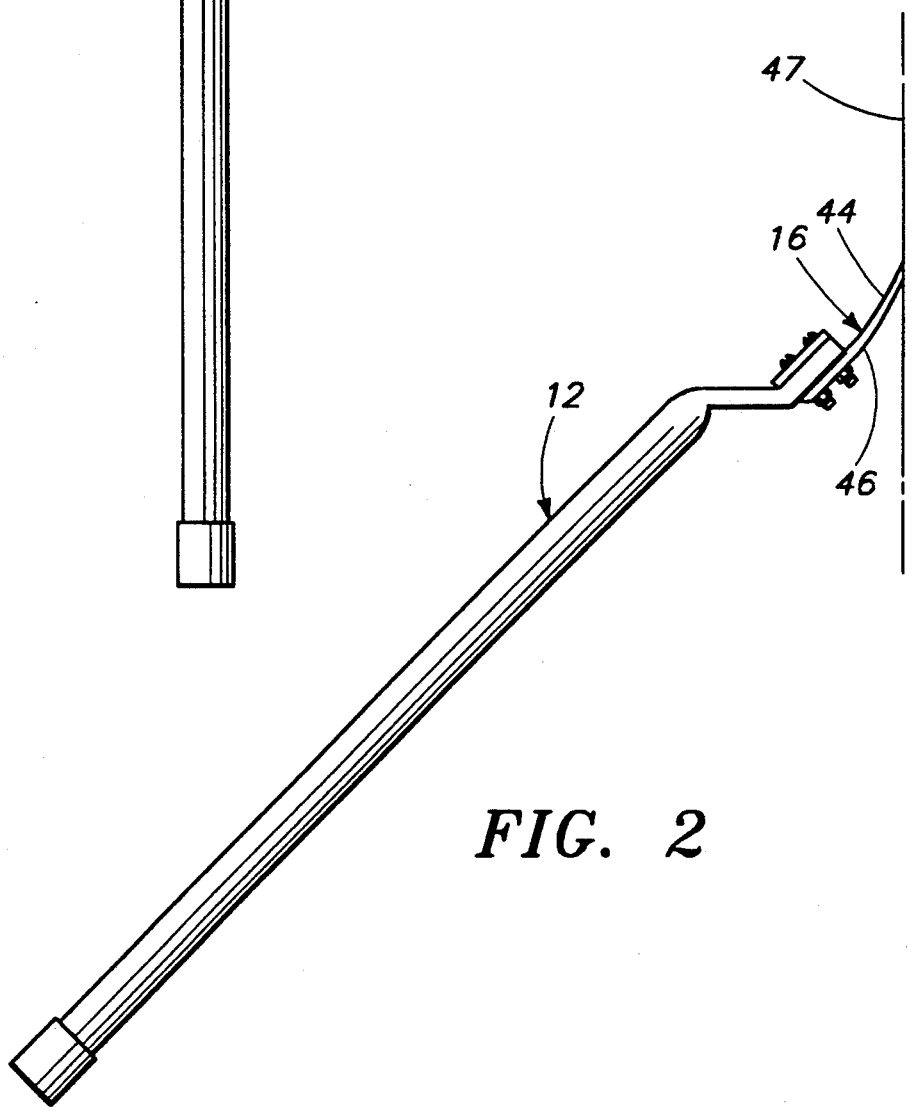
FIG. 2 is an orthographic side view of the invention.

Handle 12 does not have to be held at a precise angle to work a wall surface 47 in order that trowel blade 16 will impart a smooth finish to the plaster. FIG. 2 shows handle 12 at an angle of about thirty degrees to the plane of wall surface 47. Within limits, the handle can be held at other angles, less than thirty degrees or greater than thirty degrees. The convexly curved nature of blade surface 46 enables the blade surface to have extensive facial contact with wall surface 47 even though handle 12 is angled at some lesser angle, e.g. fifteen degrees, or at some greater angle, e.g. forty-five degrees. The trowel mechanism produces a satisfactory surface finish without requiring a precise angulation of handle 12 relative to the wall surface.

During movement of the trowel blade in the arrow 48 direction some plaster may accumulate on the advancing blade face 46 if too much manual pressure is applied to handle 12. Plaster accumulations can be avoided by using less manual force on handle 12. The plaster-smoothing function is achieved by a one-way motion of blade 16. If it is desired to make a second pass over a given surface, the blade should be lifted from gypsum joint compound surface and return to a desired starting point for a second attempt in the arrow 48 direction.

When working on vertical walls, blade 16 can be drawn in a horizontal path or in a vertical path (up or down). Wall areas near the ceiling are most easily traversed by a downward pulling motion on handle 12. Wall areas near the floor are more easily covered by an upward motion of the blade.

Blade 16 can be of various different lengths suited to the workman's physical capabilities. A blade length of about eighteen inches is preferred, as a compromise between physical capabilities of the workman and the desire for a reasonably large area coverage for a given pass of the trowel blade. Blade holder 14 is preferably somewhat shorter than the blade (e.g. sixteen inches) in order that the end edge 34 of the blade is free to move along interior corners of the room without edge contact between the blade holder and the adjacent wall surface.

The mechanism is designed to have a relatively long blade length without making the mechanism excessively heavy. Blade 16 can be formed of thin gage steel for wearability. The other components can be formed of light weight materials, e.g. aluminum, or rigid plastics.

Figures 3, 4:
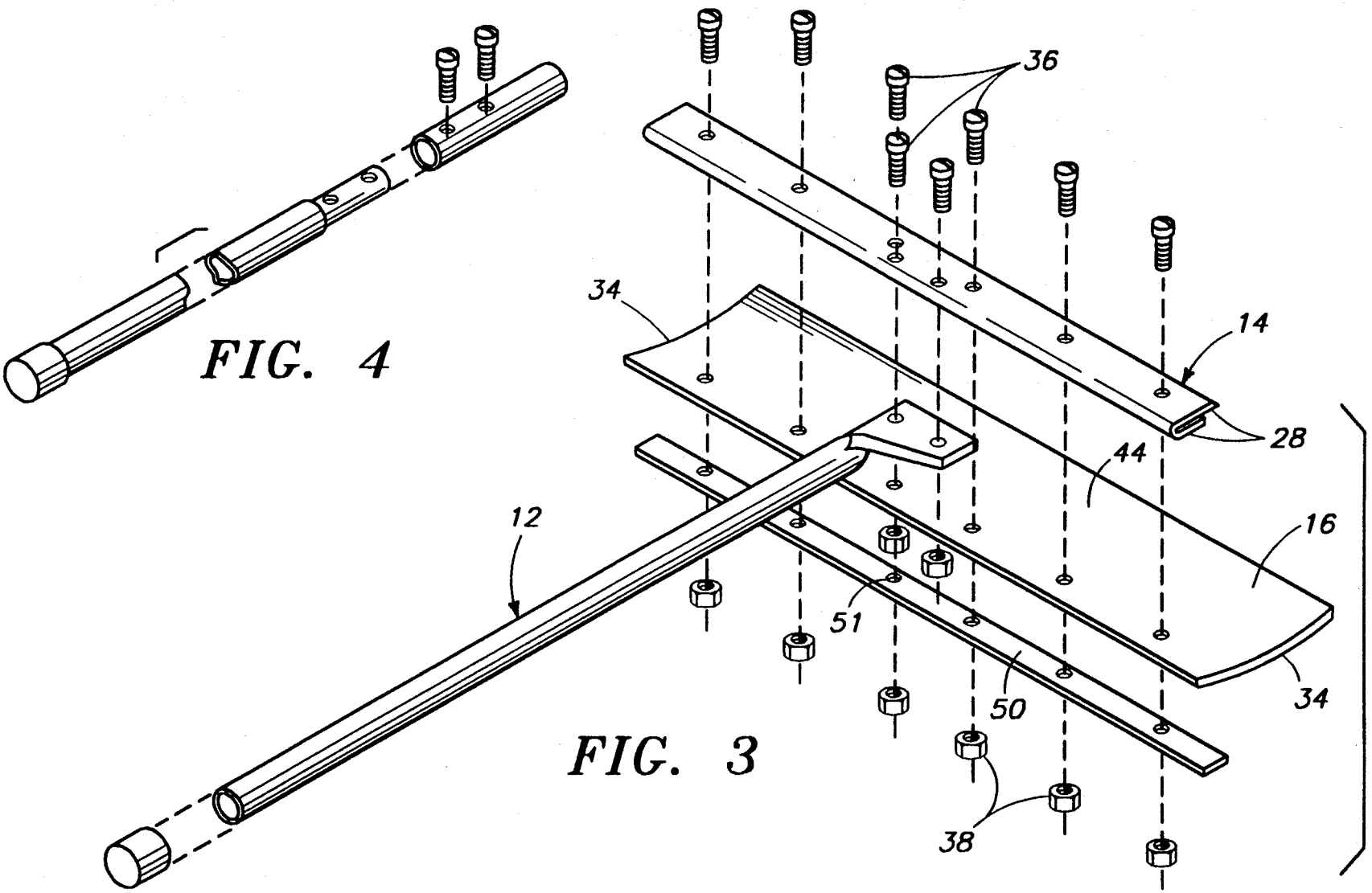
FIG. 3 is an isometric illustration, somewhat exploded, of the organization utilizing a reinforcing blade plate.
FIG. 4 is an indication fixedly mounting an extension handle relative to the handle structure of the invention.
Figures 5, 6:
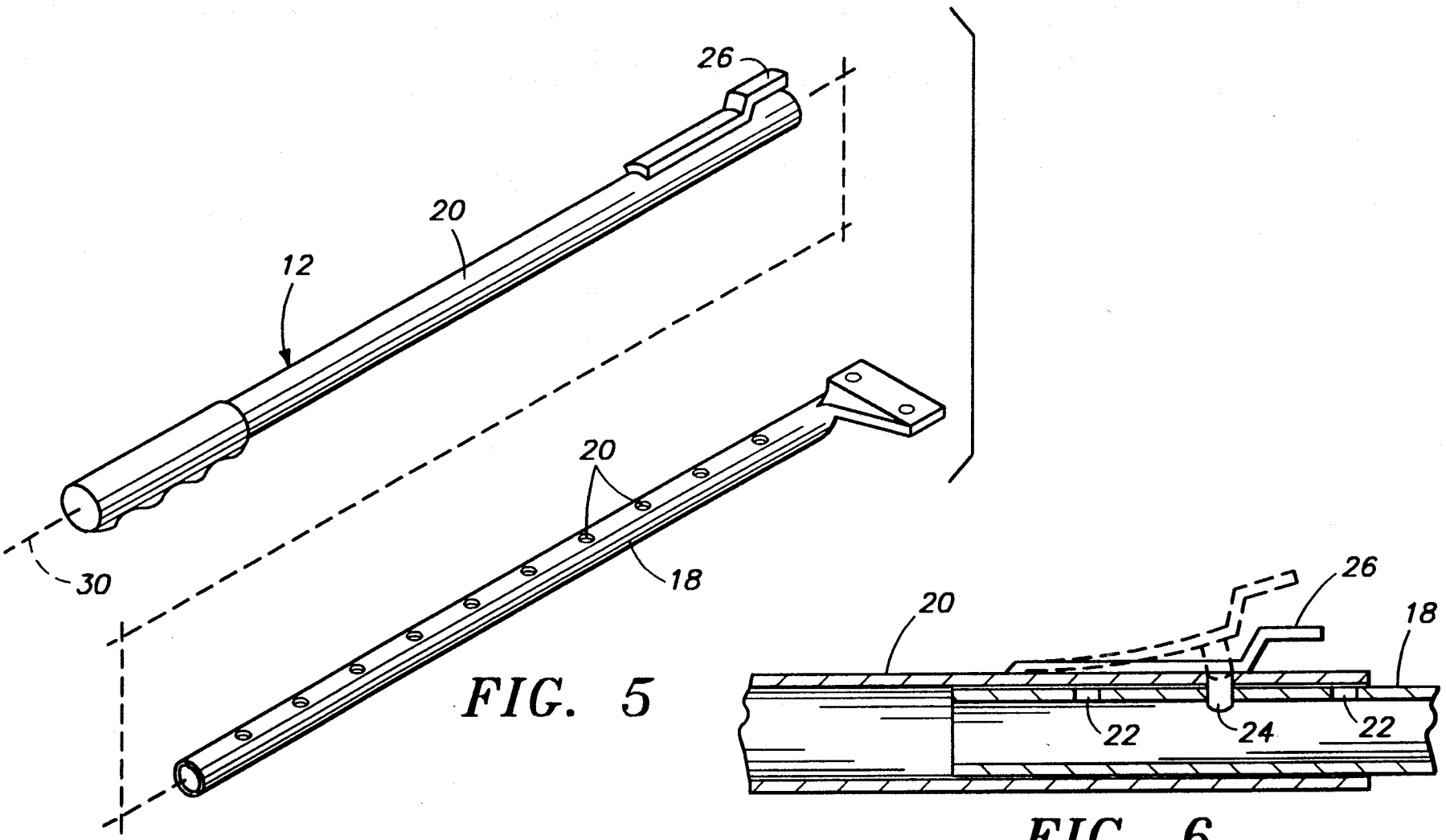
FIG. 5 is an isometric illustration illustrating the use of a telescoping handle structure employed by the invention.
FIG. 6 is an orthographic cross-sectional illustration of the inter-engaging locking relationship of the outer tubular component relative to an inner tubular component.

FIG. 3 also indicates the use of a reinforcing flange mounted below the blade 16, having reinforcing flange apertures 51 arranged to receive each one of the fasteners 36.

The FIGS. 7–10 indicate the use of a modified channel member having the plates 28 to include clamp bosses 53 that are internally threaded to threadedly receive clamp rods 56. The clamp rods 56 are positioned to impose the clamp plates 55, as indicated, onto an uppermost clamping flange 28. Between the clamp flange 28 and a clamp plate 55 are interposed stiffening wedges 52 as desired to provide for selective stiffening of the blade 16 in use. The triangular cross-sectional configuration wedge shaped plates 52 are substantially coextensive with the clamping flanges 28 to effect stiffening of the blade 16 as the wedge plates 52 are interposed upon the convex surface 44 of the blade structure 16.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drywall trowel adapter for manual movement along wet gypsum joint compound surface on ceilings or vertical walls to form a relatively smooth wall surface leaving voids between sprayed flattened dots; said trowel comprising an elongated handle having a handle axis; an elongated blade holder connected at its midpoint to one end of said handle, said blade holder comprising spaced elongated flat plates having a longitudinal axis extending normal to the handle axis; and an elongated blade adapted to seat flatwise between said plates; said blade having a transverse width greater than the transverse width of the plates whereby a longitudinal edge section of the blade projects beyond a longitudinal edge of the plate; said projecting section of the blade having a transverse curvature so that a convex face of the blade has substantial working surface area to contact said gypsum joint compound surface, and the blade holder includes a plurality of internally threaded clamp bosses orthogonally oriented relative to the plates and positioned exteriorly thereof, with at least one clamping plate mounted over each of said bosses, and a clamp rod directed through a respective clamping plate and received within each of said respective bosses, and at least one wedge-shaped plate mounted between the clamping plates and the blade to effect selective reinforcing rigidity of said blade, with the wedge plate extending substantially coextensive with the blade holder.

2. The trowel of claim 1 wherein the handle includes two telescopically connected handle components that are longitudinally adjustable relative to one another to change the effective length of the handle.

* * * * *